US010612407B2

(12) United States Patent
Lutjen et al.

(10) Patent No.: US 10,612,407 B2
(45) Date of Patent: Apr. 7, 2020

(54) CONTOURED BLADE OUTER AIR SEAL FOR A GAS TURBINE ENGINE

(71) Applicant: United Technologies Corporation, Hartford, CT (US)

(72) Inventors: Paul M. Lutjen, Kennebunkport, ME (US); Michael J. Bruskotter, Cape Neddick, ME (US)

(73) Assignee: United Technologies Corporation, Farmington, CT (US)

( * ) Notice: Subject to any disclaimer, the term of this patent is extended or adjusted under 35 U.S.C. 154(b) by 1079 days.

(21) Appl. No.: 14/771,281

(22) PCT Filed: Feb. 4, 2014

(86) PCT No.: PCT/US2014/014593
§ 371 (c)(1),
(2) Date: Aug. 28, 2015

(87) PCT Pub. No.: WO2014/171997
PCT Pub. Date: Oct. 23, 2014

(65) Prior Publication Data

US 2016/0003082 A1 Jan. 7, 2016

Related U.S. Application Data

(60) Provisional application No. 61/770,689, filed on Feb. 28, 2013.

(51) Int. Cl.
*F01D 11/08* (2006.01)
*F01D 11/12* (2006.01)
(Continued)

(52) U.S. Cl.
CPC ..... *F01D 11/12* (2013.01); *F01D 9/041* (2013.01); *F01D 11/08* (2013.01); *F01D 25/12* (2013.01);
(Continued)

(58) Field of Classification Search
CPC ..... F01D 11/08; F01D 11/12; F01D 25/12; F01D 9/041; F05D 2220/32;
(Continued)

(56) References Cited

U.S. PATENT DOCUMENTS 3,082,010 A 3/1963 Walton et al.
4,767,266 A 8/1988 Holz et al.
(Continued)

FOREIGN PATENT DOCUMENTS

JP H1113410 1/1999

OTHER PUBLICATIONS

Machine Translation JPH 1113410 Done Sep. 4, 2019 (Year: 2019).*
(Continued)

*Primary Examiner* — Patrick D Maines
*Assistant Examiner* — Dapinder Singh
(74) *Attorney, Agent, or Firm* — Carlson, Gaskey & Olds, P.C.

(57) ABSTRACT

A blade outer air seal (BOAS) segment according to an exemplary aspect of the present disclosure includes, among other things, a seal body having a radially inner face that circumferentially extend between a first mate face and a second mate face and axially extend between a leading edge face and a trailing edge face, wherein a radial position of the radially inner face varies at a given axial position.

31 Claims, 4 Drawing Sheets

(51) Int. Cl.
*F01D 9/04* (2006.01)
*F01D 25/12* (2006.01)

(52) U.S. Cl.
CPC ..... *F05D 2220/32* (2013.01); *F05D 2240/11* (2013.01); *F05D 2240/12* (2013.01); *F05D 2250/711* (2013.01); *F05D 2250/712* (2013.01); *F05D 2260/202* (2013.01)

(58) Field of Classification Search
CPC ..... F05D 2240/11; F05D 2240/12; F05D 2250/711; F05D 2250/712; F05D 2260/202
USPC ..... 415/173.1
See application file for complete search history.

(56) References Cited

U.S. PATENT DOCUMENTS 6,669,445 B2 12/2003 Staubach et al.
6,887,528 B2 5/2005 Lau et al.
7,302,990 B2 12/2007 Bunker et al.
7,473,073 B1 * 1/2009 Liang ..... F01D 5/20 415/173.5
7,497,660 B2 * 3/2009 Liang ..... F01D 5/08 415/115
7,600,968 B2 10/2009 Nelson et al.
7,726,936 B2 * 6/2010 Keller ..... F01D 11/12 415/173.4
7,740,445 B1 * 6/2010 Liang ..... F01D 5/187 415/173.5
7,922,444 B2 * 4/2011 Propheter-Hinckley ..... F01D 11/005 29/888.3
8,061,989 B1 * 11/2011 Liang ..... F01D 5/187 416/97 R
8,105,019 B2 1/2012 McCaffrey et al.
8,206,115 B2 7/2012 Siden et al.
8,579,581 B2 11/2013 Tallman
8,926,270 B2 1/2015 Karafillis et al.
2008/0080972 A1 4/2008 Bunker
2010/0104426 A1 4/2010 Keller et al.
2012/0027574 A1 2/2012 Belanger et al.
2012/0207586 A1 8/2012 Chehab et al.
2013/0017058 A1 1/2013 Joe et al.
2013/0042475 A1 2/2013 Schulte et al.
2013/0045370 A1 2/2013 Aho et al.
2013/0156550 A1 6/2013 Franks et al.
2013/0156556 A1 6/2013 Franks et al.
2013/0170962 A1 7/2013 Chouhan
2013/0170964 A1 7/2013 Chouhan et al.
2014/0112753 A1 4/2014 Zhang et al.
2014/0140833 A1 5/2014 Albers et al.

OTHER PUBLICATIONS

International Search Report and Written Opinion for International Application No. PCT/US2014/014593 dated Nov. 19, 2014.
International Preliminary Report on Patentability for PCT Application No. PCT/US2014/014593, dated Sep. 11, 2015.
Extended European Search Report for Application No. 14785115.8 dated May 18, 2016.

* cited by examiner

CONTOURED BLADE OUTER AIR SEAL FOR A GAS TURBINE ENGINE

BACKGROUND

This disclosure relates to a contoured blade outer air seal (BOAS) that may be incorporated into a gas turbine engine.

Gas turbine engines typically include a compressor section, a combustor section, and a turbine section. During operation, air is pressurized in the compressor section and is mixed with fuel and burned in the combustor section to generate hot combustion gases. The hot combustion gases are communicated through the turbine section, which extracts energy from the hot combustion gases to power the compressor section and other gas turbine engine loads.

The compressor and turbine sections of a gas turbine engine typically include alternating rows of rotating blades and stationary vanes. The turbine blades rotate and extract energy from the hot combustion gases that are communicated through the gas turbine engine. The turbine vanes prepare the airflow for the next set of blades. The vanes extend from walls that may be contoured to manipulate flow.

An outer casing of an engine static structure may include one or more blade outer air seals (BOAS) that provide an outer radial flow path boundary for the hot combustion gases. The BOAS are axially adjacent an array of vanes. There are typically more BOAS than vanes within an engine. The interface between vanes and BOAS thus varies.

SUMMARY

A blade outer air seal (BOAS) segment according to an exemplary aspect of the present disclosure includes, among other things, a seal body having a radially inner face that circumferentially extend between a first mate face and a second mate face and axially extend between a leading edge face and a trailing edge face, wherein a radial position of the radially inner face varies at a given axial position.

In a further non-limiting embodiment of the foregoing BOAS segment, the given axial position is upstream from a rub track of the radially inner face.

In a further non-limiting embodiment of any of the foregoing BOAS segments, the given axial position is a first given axial position, and a radial position of the radially inner face varies at a second given axial position that is downstream from the rub track of the radially inner face.

In a further non-limiting embodiment of any of the foregoing BOAS segments, the radial position of the radially inner face smoothly varies at the given axial position.

In a further non-limiting embodiment of any of the foregoing BOAS segments, the radial position of the radially inner face undulates at the given axial position between positions that are radially closer to the a central axis and positions that are radially further from the central axis.

In a further non-limiting embodiment of any of the foregoing BOAS segments, the radial position of the radially inner face is contoured.

In a further non-limiting embodiment of any of the foregoing BOAS segments, the BOAS includes at least a layer of an additive manufacturing material.

A blade outer air seal (BOAS) assembly according to another exemplary aspect of the present disclosure includes, among other things, a BOAS segment including a radial inner face that circumferentially extends between a first mate face and a second mate face and axially extends between a leading edge face and a trailing edge face; and at least one contour extending radially a prescribed distance from another area of the radially inner face.

In a further non-limiting embodiment of the foregoing BOAS assembly, the at least one contour includes a contour at the leading edge face configured to align with a contour extending radial a prescribed distance from a vane wall of a vane stage that is directly upstream from the BOAS segment.

In a further non-limiting embodiment of the foregoing BOAS assembly, the at least one contour is entirely upstream from a rub track of the radially inner face.

In a further non-limiting embodiment of any of the foregoing BOAS assemblies, the at least one contour includes more than one peak, trough, or both.

In a further non-limiting embodiment of any of the foregoing BOAS assemblies, the at least one contour includes a contour having first axial end and an opposing, second axial end, an circumferential width of the first axial end greater than a circumferential width of the second axial end.

In a further non-limiting embodiment of any of the foregoing BOAS assemblies, the at least one contour includes a first contour that is upstream from a rub track of the radially inner face and a second contour that is downstream from the rub track.

In a further non-limiting embodiment of any of the foregoing BOAS assemblies, the second contour extends to the trailing edge face and is configured to align with a contour extending radially a prescribed distance from a vane wall of a vane stage that is directly downstream from the BOAS segment.

In a further non-limiting embodiment of any of the foregoing BOAS assemblies, at least one cooling hole having an exit at the at the least one contour.

In a further non-limiting embodiment of any of the foregoing BOAS assemblies, the BOAS segment is a first BOAS segment, and a second BOAS segment interfaces with the first BOAS segment at the first mate face, the second BOAS segment having a second radially inner face and at least one second contour extending radially a prescribed distance from the second radially inner face, wherein a position of the at least one first contour on the first radially inner face is different than a position of the at least one second contour on the second radially inner face.

A method of providing a Blade Outer Air Seal (BOAS) configured to influence flow within a gas turbine engine according to an exemplary aspect of the present disclosure includes, among other things, providing a feature of a BOAS, the feature configured to influence flow moving across a radially inner face of a BOAS.

In a further non-limiting embodiment of the foregoing method, the feature is a continuation of a feature of a vane wall that is axially adjacent the BOAS.

In a further non-limiting embodiment of any of the foregoing methods, using an additive manufacturing process to form at least a portion of the BOAS.

In a further non-limiting embodiment of any of the foregoing methods, the feature causes a radial position of the radially inner face to vary at a given axial position.

Although the different examples have the specific components shown in the illustrations, embodiments of this disclosure are not limited to those particular combinations.

It is possible to use some of the components or features from one of the examples in combination with features or components from another one of the examples.

DETAILED DESCRIPTION

Figure 1:
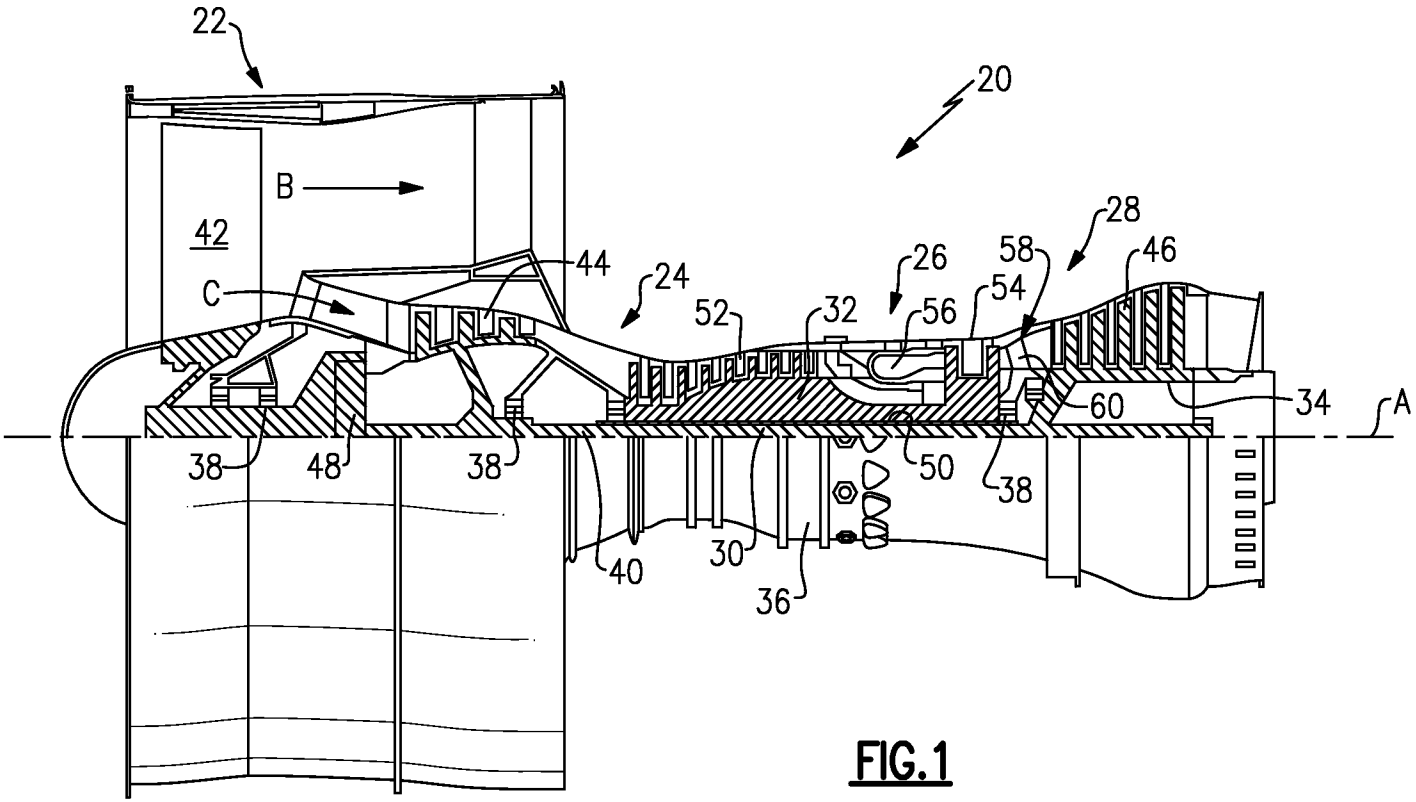
FIG. 1 illustrates a schematic, cross-sectional view of a gas turbine engine.

FIG. 1 schematically illustrates an example gas turbine engine 20 that includes a fan section 22, a compressor section 24, a combustor section 26, and a turbine section 28. Alternative engines might include an augmenter section (not shown) among other systems or features. The fan section 22 drives air along a bypass flow path B while the compressor section 24 draws air in along a core flow path C where air is compressed and communicated to a combustor section 26. In the combustor section 26, air is mixed with fuel and ignited to generate a high pressure exhaust gas stream that expands through the turbine section 28 where energy is extracted and utilized to drive the fan section 22 and the compressor section 24.

Although the disclosed non-limiting embodiment depicts a turbofan gas turbine engine, it should be understood that the concepts described herein are not limited to use with turbofans as the teachings may be applied to other types of turbine engines; for example a turbine engine including a three-spool architecture in which three spools concentrically rotate about a common axis and where a low spool enables a low pressure turbine to drive a fan via a gearbox, an intermediate spool that enables an intermediate pressure turbine to drive a first compressor of the compressor section, and a high spool that enables a high pressure turbine to drive a high pressure compressor of the compressor section.

The example engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided.

The low speed spool 30 generally includes an inner shaft 40 that connects a fan 42 and a low pressure (or first) compressor section 44 to a low pressure (or first) turbine section 46. The inner shaft 40 drives the fan 42 through a speed change device, such as a geared architecture 48, to drive the fan 42 at a lower speed than the low speed spool 30. The high speed spool 32 includes an outer shaft 50 that interconnects a high pressure (or second) compressor section 52 and a high pressure (or second) turbine section 54. The inner shaft 40 and the outer shaft 50 are concentric and rotate via the bearing systems 38 about the engine central longitudinal axis A.

A combustor 56 is arranged between the high pressure compressor 52 and the high pressure turbine 54. In one example, the high pressure turbine 54 includes at least two stages to provide a double stage high pressure turbine 54. In another example, the high pressure turbine 54 includes only a single stage. As used herein, a "high pressure" compressor or turbine experiences a higher pressure than a corresponding "low pressure" compressor or turbine.

The example low pressure turbine 46 has a pressure ratio that is greater than about 5. The pressure ratio of the example low pressure turbine 46 is measured prior to an inlet of the low pressure turbine 46 as related to the pressure measured at the outlet of the low pressure turbine 46 prior to an exhaust nozzle.

A mid-turbine frame 58 of the engine static structure 36 is arranged generally between the high pressure turbine 54 and the low pressure turbine 46. The mid-turbine frame 58 further supports bearing systems 38 in the turbine section 28 as well as setting airflow entering the low pressure turbine 46.

The core airflow C is compressed by the low pressure compressor 44 then by the high pressure compressor 52 mixed with fuel and ignited in the combustor 56 to produce high speed exhaust gases that are then expanded through the high pressure turbine 54 and low pressure turbine 46. The mid-turbine frame 58 includes vanes 60, which are in the core airflow path and function as an inlet guide vane for the low pressure turbine 46. Utilizing the vane 60 of the mid-turbine frame 58 as the inlet guide vane for low pressure turbine 46 decreases the length of the low pressure turbine 46 without increasing the axial length of the mid-turbine frame 58. Reducing or eliminating the number of vanes in the low pressure turbine 46 shortens the axial length of the turbine section 28. Thus, the compactness of the gas turbine engine 20 is increased and a higher power density may be achieved.

The disclosed gas turbine engine 20 in one example is a high-bypass geared aircraft engine. In a further example, the gas turbine engine 20 includes a bypass ratio greater than about six (6), with an example embodiment being greater than about ten (10). The example geared architecture 48 is an epicyclical gear train, such as a planetary gear system, star gear system or other known gear system, with a gear reduction ratio of greater than about 2.3.

In one disclosed embodiment, the gas turbine engine 20 includes a bypass ratio greater than about ten (10:1) and the fan diameter is significantly larger than an outer diameter of the low pressure compressor 44. It should be understood, however, that the above parameters are only exemplary of one embodiment of a gas turbine engine including a geared architecture and that the present disclosure is applicable to other gas turbine engines.

A significant amount of thrust is provided by the bypass flow B due to the high bypass ratio. The fan section 22 of the engine 20 is designed for a particular flight condition—typically cruise at about 0.8 Mach and about 35,000 feet. The flight condition of 0.8 Mach and 35,000 ft., with the engine at its best fuel consumption—also known as "bucket cruise Thrust Specific Fuel Consumption ('TSFC')"—is the industry standard parameter of pound-mass (lbm) of fuel per hour being burned divided by pound-force (lbf) of thrust the engine produces at that minimum point.

"Low fan pressure ratio" is the pressure ratio across the fan blade alone, without a Fan Exit Guide Vane ("FEGV") system. The low fan pressure ratio as disclosed herein according to one non-limiting embodiment is less than about 1.50. In another non-limiting embodiment the low fan pressure ratio is less than about 1.45.

"Low corrected fan tip speed" is the actual fan tip speed in ft/sec divided by an industry standard temperature correction of [(Tram °R)/(518.7°R)]^0.5. The "Low corrected fan tip speed," as disclosed herein according to one non-limiting embodiment, is less than about 1150 ft/second.

The example gas turbine engine includes the fan 42 that comprises in one non-limiting embodiment less than about twenty-six (26) fan blades. In another non-limiting embodiment, the fan section 22 includes less than about twenty (20) fan blades. Moreover, in one disclosed embodiment the low pressure turbine 46 includes no more than about six (6) turbine rotors schematically indicated at 34. In another non-limiting example embodiment the low pressure turbine 46 includes about three (3) turbine rotors. A ratio between the number of fan blades and the number of low pressure turbine rotors is between about 3.3 and about 8.6. The example low pressure turbine 46 provides the driving power to rotate the fan section 22 and therefore the relationship between the number of turbine rotors 34 in the low pressure turbine 46 and the number of blades in the fan section 22 disclose an example gas turbine engine 20 with increased power transfer efficiency.

Figure 2:
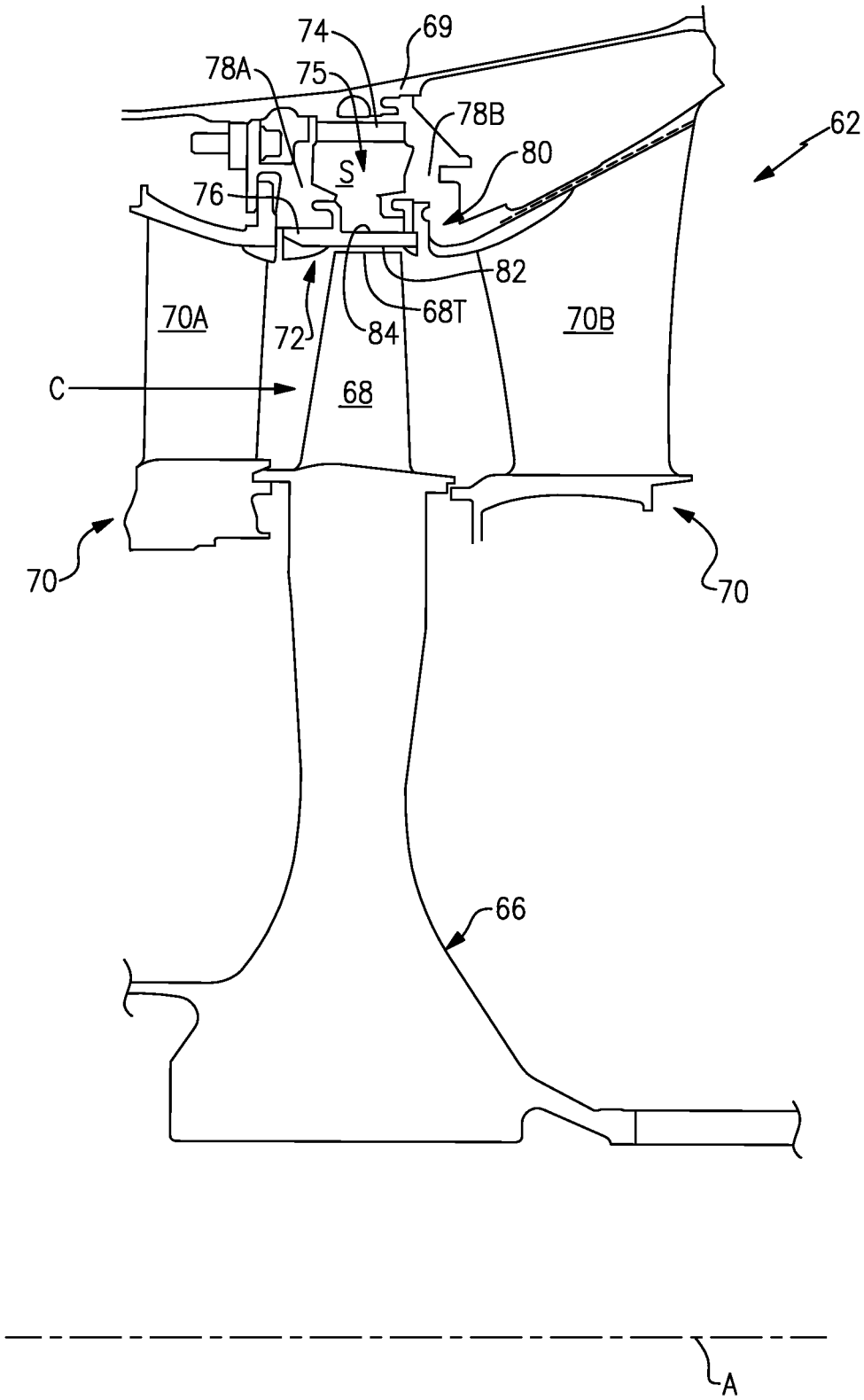
FIG. 2 illustrates a cross-section of a portion of a gas turbine engine.

FIG. 2 illustrates a portion 62 of a gas turbine engine, such as the gas turbine engine 20 of FIG. 1. In this exemplary embodiment, the portion 62 represents the high pressure turbine 54. However, it should be understood that other portions of the gas turbine engine 20 could benefit from the teachings of this disclosure, including but not limited to, the compressor section 24 and the low pressure turbine 46.

In this exemplary embodiment, a rotor disk 66 (only one shown, although multiple disks could be axially disposed within the portion 62) is mounted to the outer shaft 50 and rotates as a unit with respect to the engine static structure 36. The portion 62 includes alternating rows of rotating blades 68 (mounted to the rotor disk 66) and vanes 70A and 70B of vane assemblies 70 that are also supported within an outer casing 69 of the engine static structure 36.

Each blade 68 of the rotor disk 66 includes a blade tip 68T that is positioned at a radially outermost portion of the blades 68. The blade tip 68T extends toward a blade outer air seal (BOAS) assembly 72. The BOAS assembly 72 may find beneficial use in many industries including aerospace, industrial, electricity generation, naval propulsion, pumps for gas and oil transmission, aircraft propulsion, vehicle engines and stationery power plants.

The BOAS assembly 72 is disposed in an annulus radially between the outer casing 69 and the blade tip 68T. The BOAS assembly 72 generally includes a support structure 74 and a multitude of BOAS segments 76 (only one shown in FIG. 2). The BOAS segments 76 may form a full ring hoop assembly that encircles associated blades 68 of a stage of the portion 62. The support structure 74 is mounted radially inward from the outer casing 69 and includes forward and aft flanges 78A, 78B that mountably receive the BOAS segments 76. The forward flange 78A and the aft flange 78B may be manufactured of a metallic alloy material and may be circumferentially segmented for the receipt of the BOAS segments 76.

The support structure 74 may establish a cavity 75 that extends axially between the forward flange 78A and the aft flange 78B and radially between the outer casing 69 and the BOAS segment 76. A secondary cooling airflow S may be communicated into the cavity 75 to provide a dedicated source of cooling airflow for cooling the BOAS segments 76. The secondary cooling airflow S can be sourced from the high pressure compressor 52 or any other upstream portion of the gas turbine engine 20.

Figure 3:
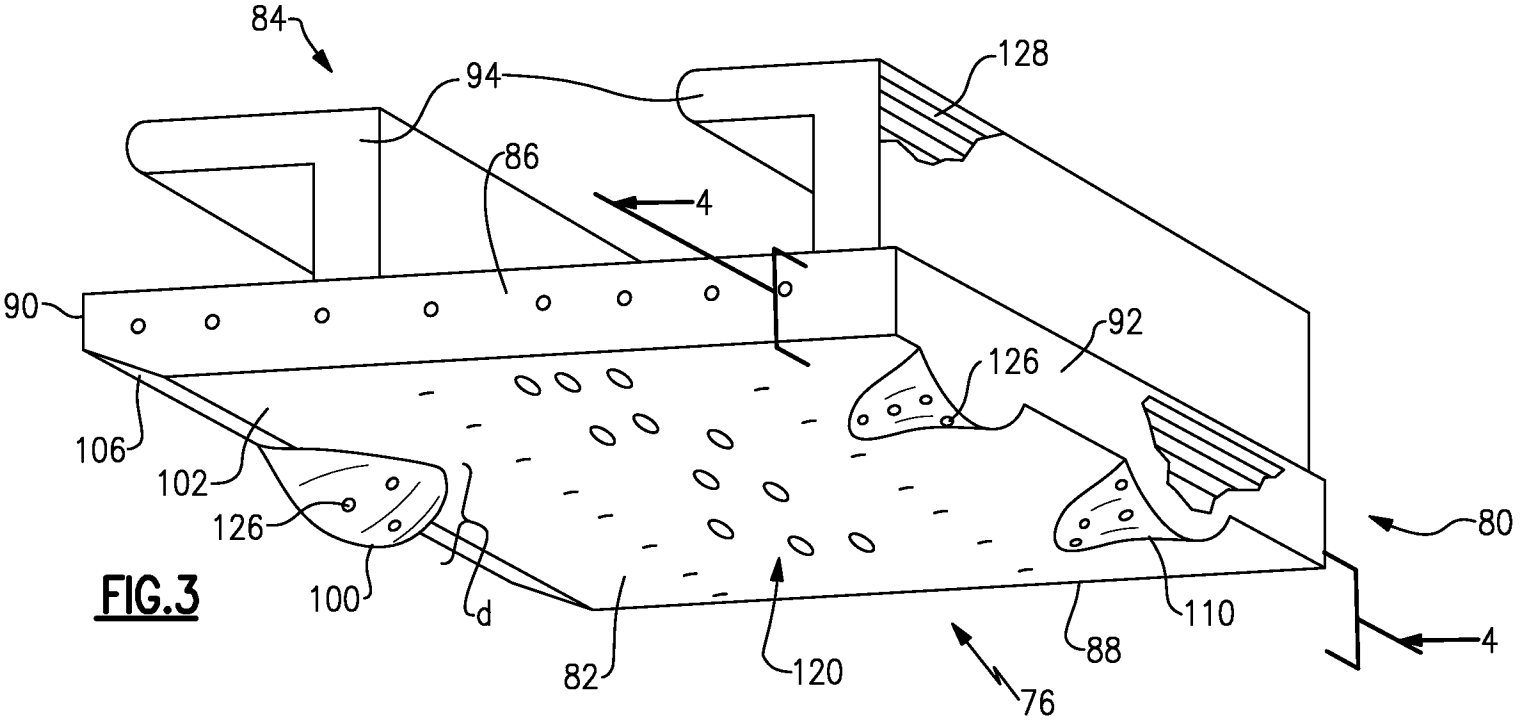
FIG. 3 illustrates a perspective view of a blade outer air seal (BOAS) segment.
Figure 4:
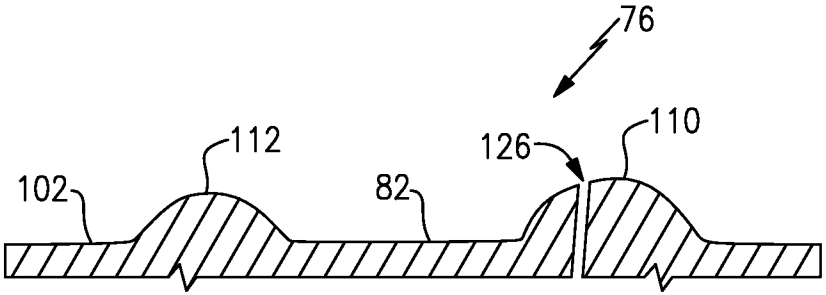
FIG. 4 shows a cross-sectional view at line 4-4 in FIG. 4.
Figure 5:
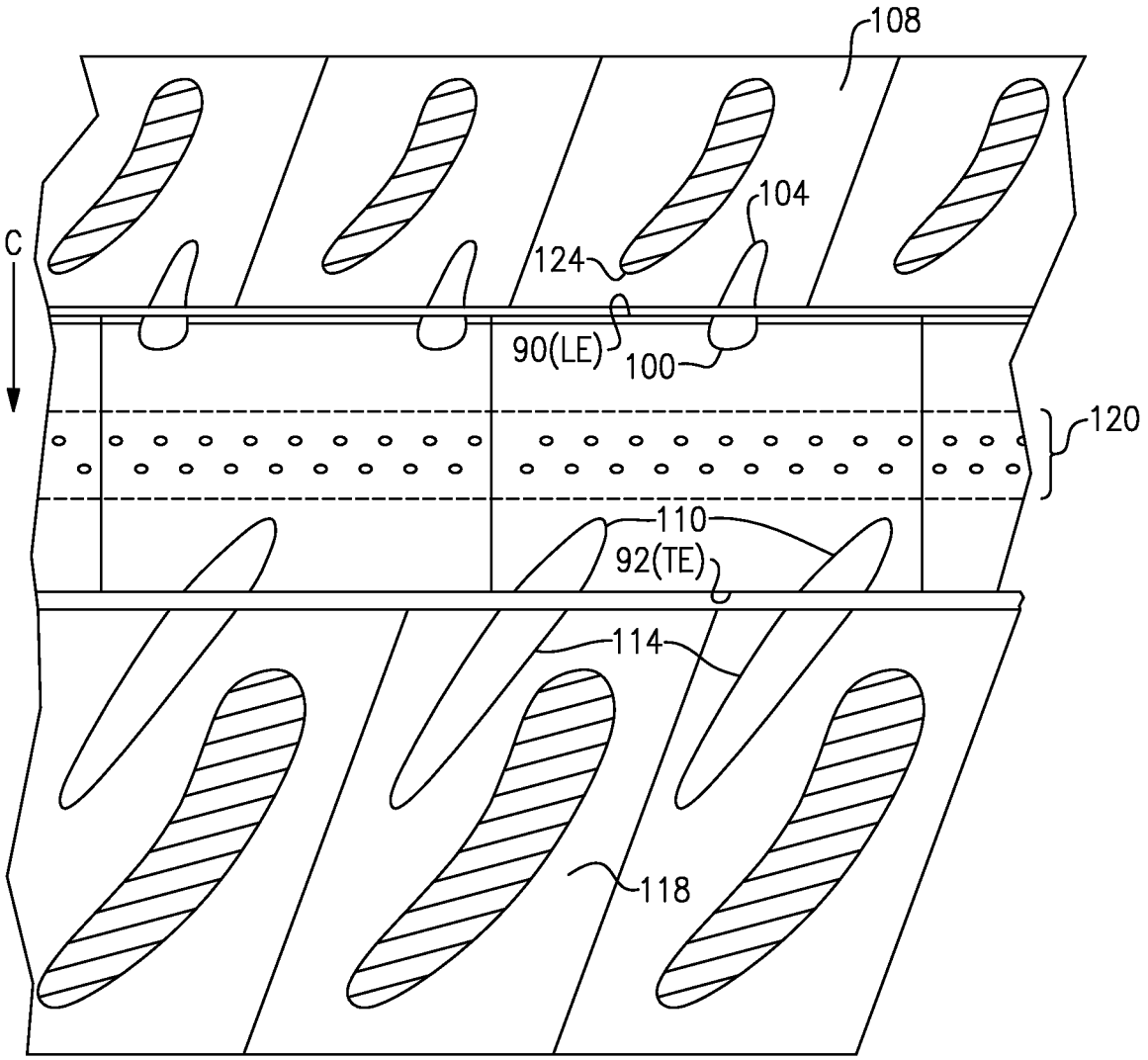
FIG. 5 shows a radially facing surface of the BOAS within the gas turbine engine of FIG. 1.

FIGS. 3 to 5 illustrates one exemplary embodiment of a BOAS segment 76 that may be incorporated into a gas turbine engine, such as the gas turbine engine 20. The BOAS segment 76 may include a seal body 80 having one or more radially inner faces 82 that face toward the blade tip 68T and one or more radially outer faces 84 that face toward the cavity 75 (See FIG. 2). The radially inner face 82 and the radially outer face 84 circumferentially extend between a first mate face 86 and a second mate face 88 and axially extend between a leading edge face 90 and a trailing edge face 92.

The first and second mate faces 86, 88 of the seal body 80 face corresponding faces of adjacent BOAS segments 76 to provide the BOAS assembly 72 in the form of a full ring hoop assembly.

The leading edge face 90 and the trailing edge face 92 may include attachment features 94 to engage the forward and aft flanges 78A, 78B to secure each BOAS segment 76 to the support structure 74 (FIG. 2). It should be understood that various interfaces and attachment features may alternatively or additionally be provided.

In this example, the radially inner face 82 includes at least one feature such as a contour 100 that is a continuation of a vane contour 104 on a vane wall 108 of one or more of the vane assemblies 70 directly upstream from the BOAS segment. The example contour 100 is a hump or ridge extending a prescribed distance from a surrounding surface 102 that is relatively noncontoured. At a given axial position, the surrounding surface 102 is located radially a relatively consistent distance from the axis A.

In this example, the seal body 80 includes a ramped area 106 near the leading edge 90. The ramped area 106 is angled relative to the axis A. However, at a given axial position within the ramped area 106, the distance from the axis A is relatively consistent, except in the area of the contour 100.

The contour 100 represents an area of the radially inner face 82 that varies from the relatively consistent distance. In one example, the contour 100 extends from the surrounding surface 102 a distance d that is up to 5 percent, or more narrowly, up to 1 percent of a length of a span of the blade 68, which corresponds generally to a height of the gaspath.

The radially inner face 82 also includes contours 110 that are continuations of contours 114 on vane wall 118 of one or more of the vane assemblies 70 directly downstream from the BOAS segment.

In this example, the contour 100 is entirely upstream from a rub track 120 of the radially inner face 82, and the contour 110 is entirely downstream from the rub track 120. The contour 100 represents an area of the radially inner face that varies at a first given axial position that is upstream the rub track 120. The contour 110 represents an area of the radially inner face 82 that varies at a second given axial position that is downstream from the rub track 120.

The rub track 120 represents the area of radially inner face 82 that directly interfaces with the blade tip 68T during operation of the engine. The rub track 120 may be slightly recessed from other areas of the radially inner face 82 due to interaction with the blade tip 68T.

Because of the contours 100 and 110, a radial position of the radially inner face 82 varies relative to the axis A at a given axial location. The section of FIG. 4 shows the BOAS segment at a given axial location and demonstrates how the radial position of the radially inner face 82 varies radially due to the contours 100. A profile 112 of the radially inner face 82 at the given axial location varies smoothly, that is, the contours 110 flow from respective peaks relatively smoothly into other (relatively planar) areas of the radially inner face 82. At this location, the contours 110 cause the radially inner face 82 to undulate between positions that are radially closer to the axis A and positions that are radially further from the axis A.

Figure 4A:
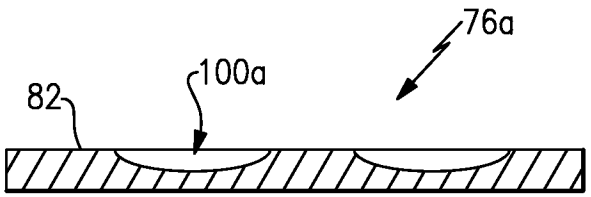
FIG. 4A shows a cross-sectional view at the same axial position as FIG. 5 in another example BOAS.

The example contours 100 and 110 extend radially toward the axis A relative to other areas of the radially inner face 82. FIG. 4A shows an example BOAS segment 76*a* having contours 100*a*, which are recessed relative to other areas of the radially inner face 82. The contours 100*a* (or troughs) cause the radial position of the radially inner face 82 to vary at a given axial location.

As flow moves past the vane contours 104 on the vane wall 108, the vane contours 104 influence the flow to inhibit, among other things, the formation of a vortex at a trailing edge 124 of the vane 70A or reduce pressure variation resultant from the vortex. The contours 100 essentially continue the flow control initiated by the vane contour 104 on the vane wall 108, which provides more effective control over flow moving past the trailing edge 124 prior to flowing past the blades 68.

The contours 100 and 110 may include features, such as cooling holes, with exits 126 at or near the contours 100 and 110. The bleed air communicated through the exits 126 suppresses distress modes such as high thermal energy levels. Such distress modes are particularly apparent when the contours 100 and 110 cause the BOAS segment 76 to be built up and radially thicker than other surrounding areas of the BOAS segment 76. Other features may include trenching within the contours 100 and 110.

In this example, each vane contour 104 on the vane wall 108 has an associated continuation on one or more of the BOAS segments 76 in the BOAS assembly 72. Depending on the circumferential orientation of the BOAS assembly 72 relative to the vane wall 108, more than one BOAS segment 76 may be required to effectively maintain the vane contour 104.

The number of BOAS segments 76 within the BOAS assembly 72 may be different than the number of vane walls 108 within the vane stage. Thus, the interfaces between the BOAS segments 76 and the vane walls 108 may vary. For example, the leading edge face 90 of one of the BOAS segments 76 may interface with two vane walls 108 and the leading edge face 90 of another of the BOAS segments 76 may interface with three vane walls 108.

The example BOAS segments 76 are designed to fit in a specific circumferential location within the engine 20 so that, among other things, the contours 100 align with the vane contour 104. The BOAS segments 76 may each include contours 110 on different areas of the radially inner face 82 depending on their circumferential position within the engine 20.

Manufacturing the BOAS segments 76 within the BOAS assembly 72 utilizing additive manufacturing techniques facilitates creating individual BOAS segments designed for a specific circumferential position. In the prior art, the casting of BOAS segments made it too costly to manufacture individual BOAS segments for a specific circumferential position.

The additive manufacturing processes utilized in this example provide the BOAS segment 76 to have multiple layers 128.

As with the contours 100, the contours 110 are continuation of the contours 114 of vanes 70B in an adjacent vane stage. The contours 110 begin to influence flow that has moved past the blades 68 prior to the flow moving past the trailing edge face 92 of the BOAS segment 76. This flow is then further influenced by the contour 114 of the vane wall 118.

Although the different non-limiting embodiments are illustrated as having specific components, the embodiments of this disclosure are not limited to those particular combinations. It is possible to use some of the components or features from any of the non-limiting embodiments in combination with features or components from any of the other non-limiting embodiments.

It should be understood that like reference numerals identify corresponding or similar elements throughout the several drawings. It should also be understood that although a particular component arrangement is disclosed and illustrated in these exemplary embodiments, other arrangements could also benefit from the teachings of this disclosure.

The foregoing description shall be interpreted as illustrative and not in any limiting sense. A worker of ordinary skill in the art would recognize that various modifications could come within the scope of this disclosure. For these reasons, the following claims should be studied to determine the true scope and content of this disclosure.

We claim:

1. A blade outer air seal (BOAS) segment, comprising:

a seal body having a radially inner face that circumferentially extends between a first mate face and a second mate face and axially extends between a leading edge face and a trailing edge face, wherein a radial position of the radially inner face varies at a given axial position, the given axial position outside a rub track of the BOAS.

2. The BOAS segment of claim 1, wherein the given axial position is upstream from the rub track of the radially inner face.

3. The BOAS segment of claim 2, wherein the given axial position is a first given axial position, and a radial position of the radially inner face varies at a second given axial position that is downstream from the rub track of the radially inner face.

4. The BOAS segment of claim 1, wherein the radial position of the radially inner face smoothly varies at the given axial position.

5. The BOAS segment of claim 1, wherein the radial position of the radially inner face undulates at the given axial position between positions that are radially closer to a central axis and positions that are radially further from the central axis.

6. The BOAS segment of claim 1, wherein the radial position of the radially inner face is contoured.

7. The BOAS segment of claim 1, wherein the BOAS includes at least a layer of an additive manufacturing material.

8. A blade outer air seal (BOAS) assembly, comprising:

a BOAS segment including a radial inner face that circumferentially extends between a first mate face and a second mate face and axially extends between a leading edge face and a trailing edge face; and at least one contour extending radially a prescribed distance from another area of the radially inner face, wherein at a given axial position, the contour varies a radial position of the radially inner face, the given axial position outside a rub track of the BOAS.

9. The BOAS assembly of claim 8, wherein the at least one contour is entirely upstream from a rub track of the radially inner face.

10. The BOAS assembly of claim 8, wherein the at least one contour includes at least one peak, trough, or both.

11. The BOAS assembly of claim 8, wherein the at least one contour includes a contour having first axial end and an opposing, second axial end, an circumferential width of the first axial end greater than a circumferential width of the second axial end.

12. The BOAS assembly of claim 8, wherein the at least one contour includes a first contour that is upstream from a rub track of the radially inner face and a second contour that is downstream from the rub track.

13. The BOAS assembly of claim 12, wherein the second contour extends to the trailing edge face and is configured to align with a contour extending radially a prescribed distance from a vane wall of a vane stage that is directly downstream from the BOAS segment.

14. The BOAS assembly of claim 8, including at least one cooling hole having an exit at the at the least one contour.

15. The BOAS assembly of claim 8, wherein the BOAS segment is a first BOAS segment, and a second BOAS segment interfaces with the first BOAS segment at the first mate face, the second BOAS segment having a second radially inner face and at least one second contour extending radially a prescribed distance from the second radially inner face, wherein a position of the at least one first contour on the first radially inner face is different than a position of the at least one second contour on the second radially inner face.

16. A blade outer air seal (BOAS) assembly, comprising:

a BOAS segment including a radial inner face that circumferentially extends between a first mate face and a second mate face and axially extends between a leading edge face and a trailing edge face; and at least one contour extending radially a prescribed distance from another area of the radially inner face, wherein the at least one contour includes a contour at the leading edge face configured to align with a contour extending radially a prescribed distance from a vane wall of a vane stage that is directly upstream from the BOAS segment.

17. A method of providing a Blade Outer Air Seal (BOAS) configured to influence flow within a gas turbine engine, comprising:

providing a feature of a BOAS, the feature configured to influence flow moving across a radially inner face of a BOAS, wherein the feature causes a radial position of the radially inner face to vary at a given axial position, the given axial position outside a rub track of the BOAS.

18. The method of claim 17, wherein the feature is a continuation of a feature of a vane wall that is axially adjacent the BOAS.

19. The method of claim 17, using an additive manufacturing process to form at least a portion of the BOAS.

20. An assembly, comprising:

a vane segment;

a blade outer air seal (BOAS) segment adjacent the vane segment; and a radially extending contour;

wherein the contour resides on both the vane segment and the BOAS segment, wherein, at a given axial location that is aligned with the contour residing on the vane segment, a radial position of a radially inner face of the vane segment varies radially, wherein, at a given axial location that is aligned with the contour residing on the BOAS segment, a radial position of a radially inner face of the BOAS segment varies radially.

21. The assembly of claim 20, wherein the contour is located on a vane wall of the vane segment.

22. The assembly of claim 20, wherein the contour is located on a radially inner face of the BOAS.

23. The assembly of claim 20, wherein the contour includes at least one peak, trough, or both.

24. The assembly of claim 20, wherein the vane segment is upstream of the BOAS segment.

25. The assembly of claim 20, wherein the vane segment is downstream of the BOAS segment.

26. The assembly of claim 20, further comprising:

a second vane segment adjacent the BOAS segment, wherein the BOAS segment is located between the vane segment and the second vane segment; and a second contour residing on both the second vane segment and the BOAS segment.

27. The assembly of claim 20, including at least one cooling hole having an exit at the contour.

28. The assembly of claim 26, further comprising:

a third vane segment adjacent the vane segment or the second vane segment; and a third contour residing on both the third vane segment and the BOAS segment.

29. The assembly of claim 20, further comprising:

a second vane segment adjacent the BOAS segment and the second vane segment; and a second contour residing on both the second vane segment and the BOAS segment.

30. A vane segment locatable adjacent a blade outer air seal (BOAS) segment, the vane segment comprising:

a vane wall; and a vane contour of the vane wall, the vane contour extending radially from other portions of said vane wall;

wherein said vane contour corresponds to a BOAS contour on the BOAS segment, wherein, at a given axial location that is aligned with said vane contour, a radial position of a radially inner face of said vane wall varies radially.

31. A blade outer air seal (BOAS) segment locatable adjacent a vane segment, the BOAS segment comprising:

a radially inner face; and a BOAS contour of the radially inner face, said BOAS contour extending radially from other portions of said inner face;

wherein said BOAS contour corresponds to a vane contour on the vane segment, wherein, at a given axial location that is aligned with said BOAS contour, a radial position of the radially inner face varies radially.

* * * * *